US005653620A

United States Patent [19]

Lin

[11] Patent Number: 5,653,620

[45] Date of Patent: Aug. 5, 1997

[54] BUBBLE TOY WITH FLEXIBLE BUBBLE COIL

[76] Inventor: Mon-Sheng Lin, 5th Fl., No. 4, Lane 7, Pao Kao Road, Hsintien, Taipei Hsien, Taiwan

[21] Appl. No.: 679,792

[22] Filed: Jul. 15, 1996

[51] Int. Cl.[6] ..... A63H 33/28

[52] U.S. Cl. ..... 446/15

[58] Field of Search ..... 446/15, 16, 17, 446/18, 19, 20, 21

[56] References Cited

U.S. PATENT DOCUMENTS

| | | | |
|---|---|---|---|
| D. 304,466 | 11/1989 | Brown | 446/15 X |
| 3,818,627 | 6/1974 | Lebensfeld | 446/15 |
| 5,183,428 | 2/1993 | Lin | 446/15 |
| 5,334,087 | 8/1994 | Messina | 446/15 |

FOREIGN PATENT DOCUMENTS

| | | | |
|---|---|---|---|
| WO92/19342 | 11/1992 | WIPO | 446/15 |

*Primary Examiner*—Robert A. Hafer
*Assistant Examiner*—D. Neal Muir
*Attorney, Agent, or Firm*—Bacon & Thomas

[57] ABSTRACT

A bubble blowing toy including a solution container containing a solution and having a threaded neck, and a bubble flower having a cap-like handle and a bubble blowing coil and a step connected between the handle and the coil, wherein the bubble blowing coil has a hollow rhombic shape comprised of two top sides and two bottom sides, the contained angle defined within the top sides being bigger than the contained angle defined within the bottom sides so that the bubble blowing coil can be deformed and inserted into the solution container to pick up the solution for blowing into bubbles.

2 Claims, 11 Drawing Sheets

BUBBLE TOY WITH FLEXIBLE BUBBLE COIL

BACKGROUND OF THE INVENTION

FIG. 1 shows a regular bubble blowing toy, which is comprised of a solution container 1' containing a solution, and a bubble blower 2' adapted for blowing the solution into bubbles. The bubble blower 2' comprises a handle 21' at one end, a bubble blowing coil 22' at an opposite end, and a stem 211' connected between the handle 21' and the bubble blowing coil 22'. The handle 21' is made in the form of a screw cap adapted for threading onto the threaded neck 11' of the solution container 1'. In order to prevent a leakage, the diameter of the threaded neck 11' is made as small as possible. However, when the diameter of the threaded neck 11' is minimized, the size of the bubble blowing coil 22' must be relatively reduced. Therefore, this design can only produce small bubbles.

SUMMARY OF THE INVENTION

The present invention provides a bubble blowing toy which is practical for producing bubbles of big sizes. According to one embodiment of the present invention, the bubble blowing toy comprises a solution container containing a solution for producing bubbles and having a threaded neck, and a bubble blower adapted for picking up the solution for blowing into bubbles, the bubble blower comprising a handle at one end, a main bubble blowing coil at an opposite end, and a stem connected between the handle and the main bubble blowing coil, the handle being made in the form of a screw cap adapted for threading onto the threaded neck of the solution container, wherein the bubble blowing coil has a hollow rhombic shape comprised of two top sides and two bottom sides, the two top sides met at one end of the stem remote from the handle, the two bottom sides having one end respectively terminating in each other and an opposite end respectively terminating in said top sides at a respective angle, the distance between the angles at the connections between the top sides and the bottom sides being longer than the inner diameter of the threaded neck of the solution container, the contained angle defined within the top sides being bigger than the contained angle defined within the bottom sides. Therefore, the bubble blowing coil can be conveniently deformed and inserted into the inside of the solution container to pick up the solution for blowing into bubbles.

DETAILED DESCRIPTION OF THE PREFERRED EMBODIMENTS

Figure 4:
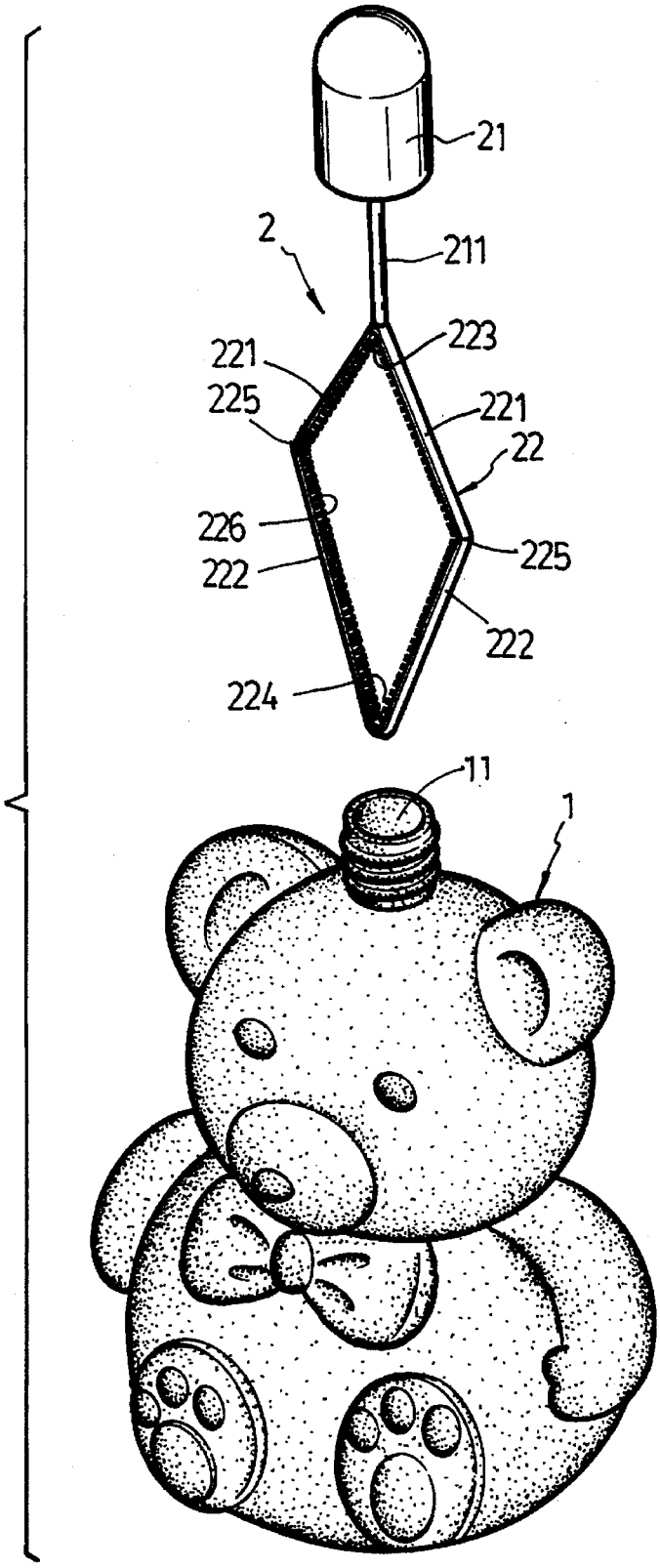
FIG. 4 is an exploded view of a bubble blowing toy according to one embodiment of the present invention.
Figure 5:
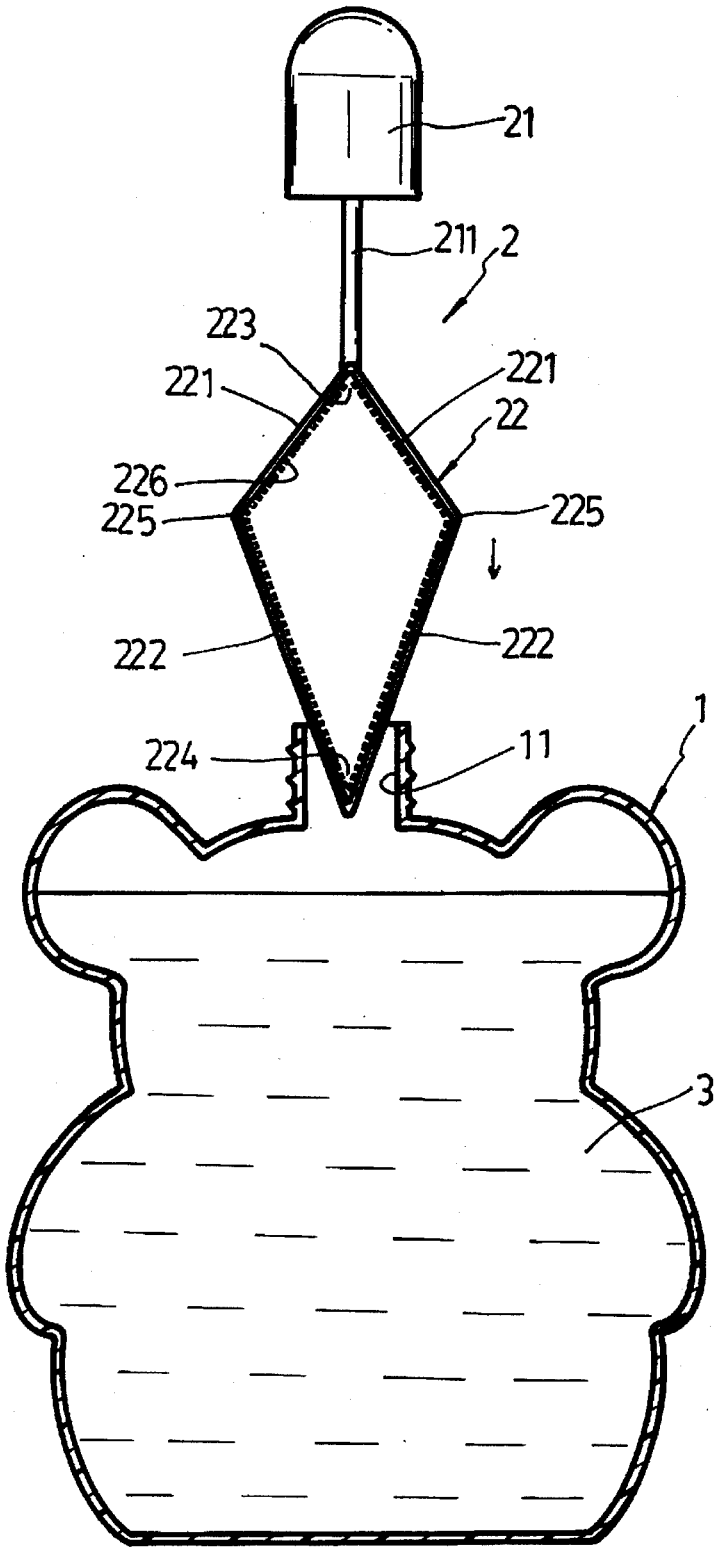
FIG. 5 is a sectional view of the bubble blowing toy shown in FIG. 4, showing the bottom end of the bubble blowing coil inserted into the threaded neck of the solution container.
Figure 9:
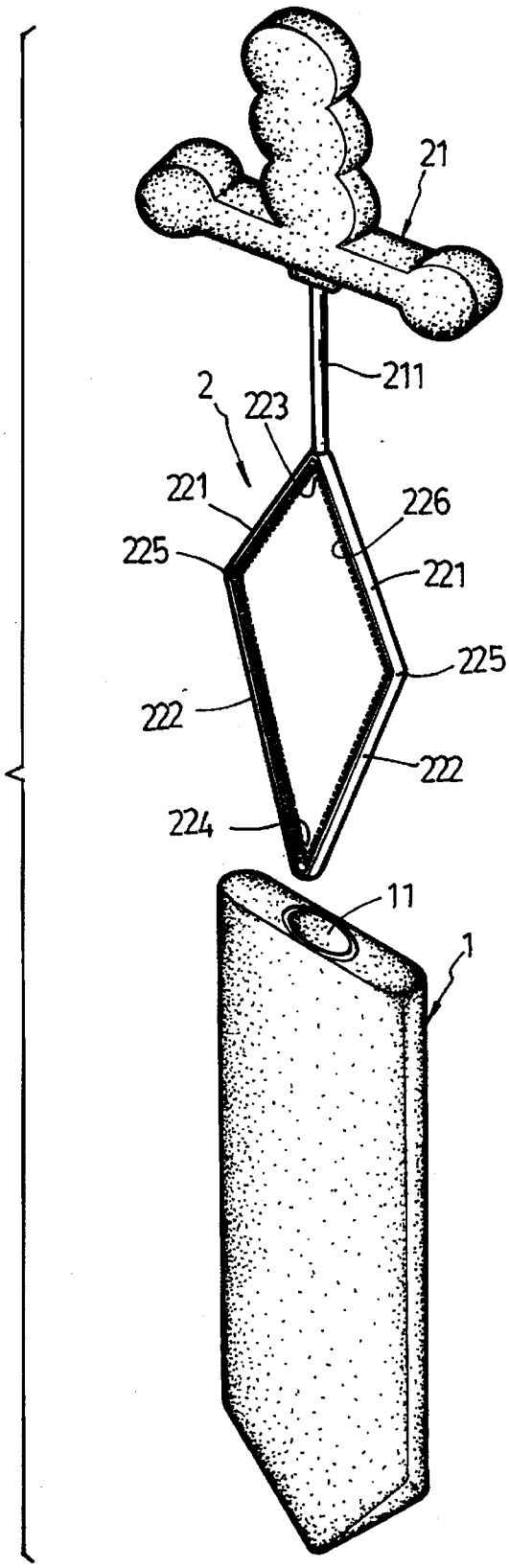
FIG. 9 shows a bubble blowing toy according to an alternate form of the present invention.

Referring to FIGS. 4 and 5, a bubble blowing toy in accordance with the present invention is comprised of a solution container 1 containing a solution 3 for producing bubbles, and a bubble blower 2 adapted for blowing the solution 3 into bubbles. The solution container 1 has a threaded neck 11 through which the bubble blower 2 can be inserted into the inside of the solution container 1 to take up the solution 3. The bubble blower 2 comprises a handle 21 at one end, a bubble blowing coil 22 at an opposite end, and a stem 211 connected between the handle 21 and the bubble blowing coil 22. The handle 21 is made in the form of a screw cap adapted for threading onto the threaded neck 11 of the solution container 1. The handle 21 and the solution container 1 may be variously shaped. In FIG. 9, the handle 21 has the shape of the mounting (handle) of a sword, and the solution container 1 has the shape of the sheath of a sword; in FIG. 10, the solution container 1 has a rounded top and flat body.

Figure 1:
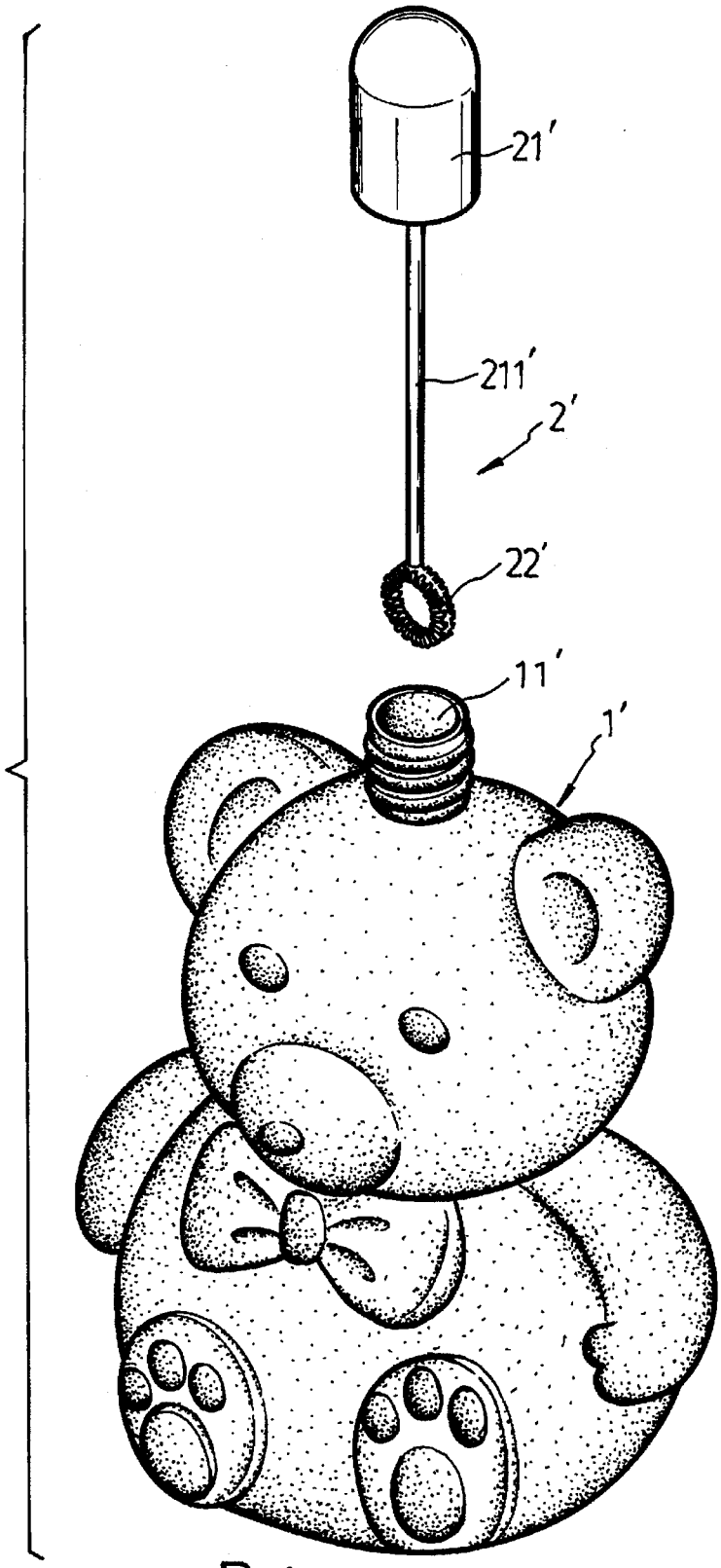
Prior Art FIG. 1
FIG. 1 is an exploded view of a bubble blowing toy according to the prior art.
Figure 2:
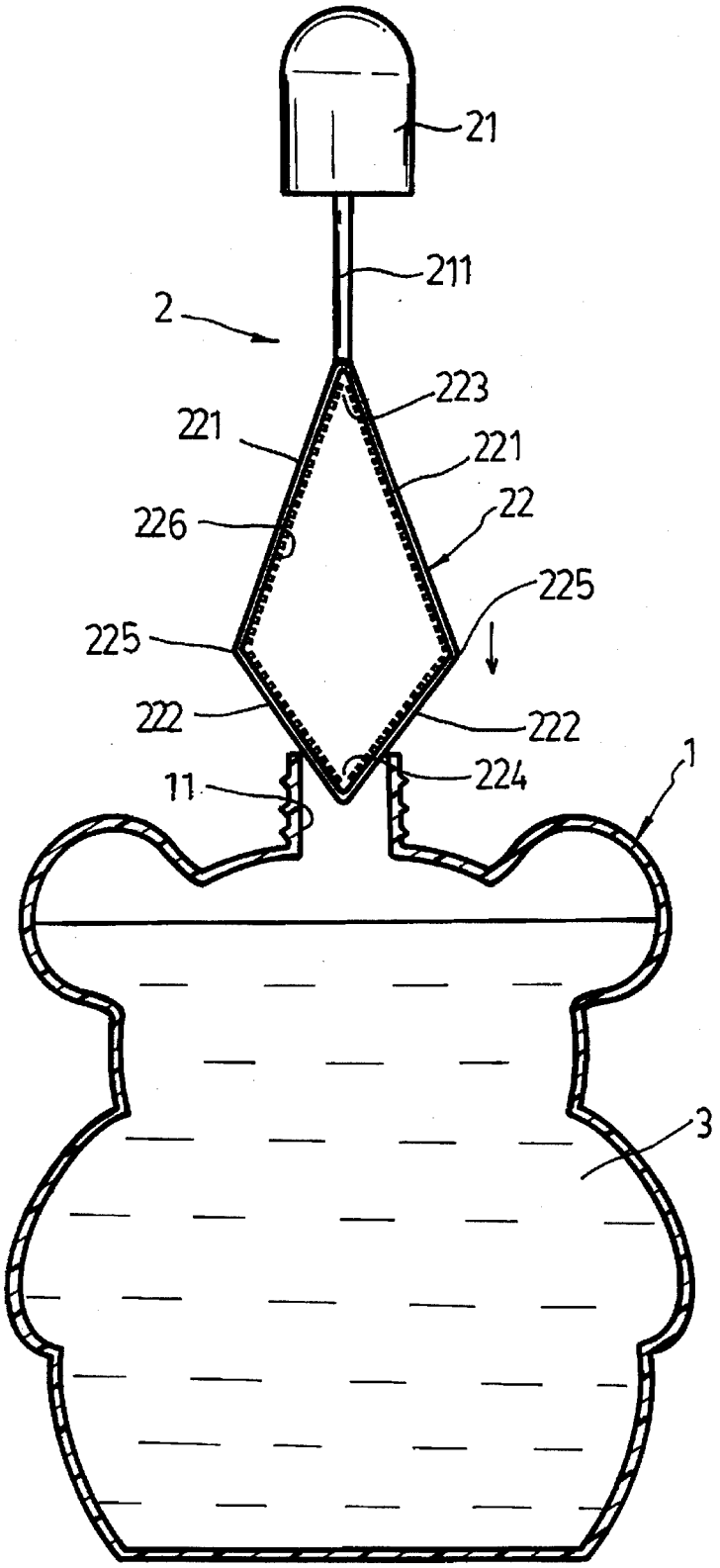
FIG. 2 is a schematic drawing showing a hollow rhombic bubble blowing coil with two short bottom sides and two long bottom sides.
Figure 3:
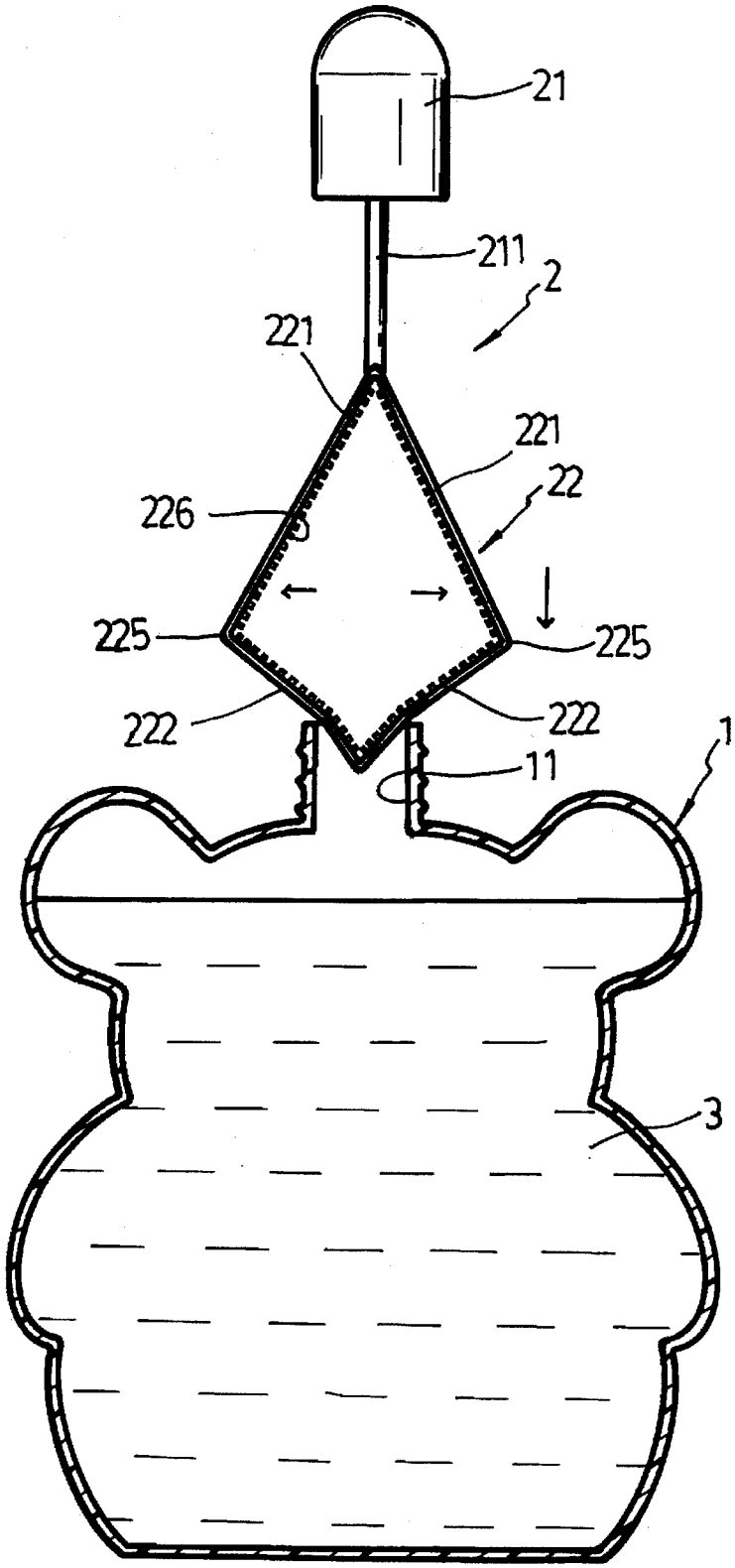
FIG. 3 shows the bubble blowing coil of FIG. 2 forced down against the threaded neck of the solution container.

Referring to FIGS. 4 and 5 again, the bubble blowing coil 22 has a hollow rhombic shape comprised of four sides, namely, the two top sides 221 and the two bottom sides 222. The two top sides 221 meet at the bottom end of the stem 211. The two bottom sides 222 have one end respectively terminating in each other and an opposite end respectively terminating in the top sides 221. The distance between the angles 225 at the connections between the top sides 221 and the bottom sides 222, is longer than the inner diameter of the threaded neck 11 of the solution container 1. The contained angle 223 defined within the top sides 221 is bigger than the contained angle 224 defined within the bottom sides 222, i.e., the top sides 221 are relatively shorter than the bottom sides 222 so that the bubble blowing coil 22 can be deformed and inserted through the threaded neck 11 into the inside of the solution container 1 to pick up the solution 3. If the top sides 221 are made longer than the bottom sides 222, the bubble blowing coil 22 will be unable to be inserted through the threaded neck 11 into the inside of the solution container 1 to pick up the solution 3 (see FIGS. 2 and 3).

Figure 6:
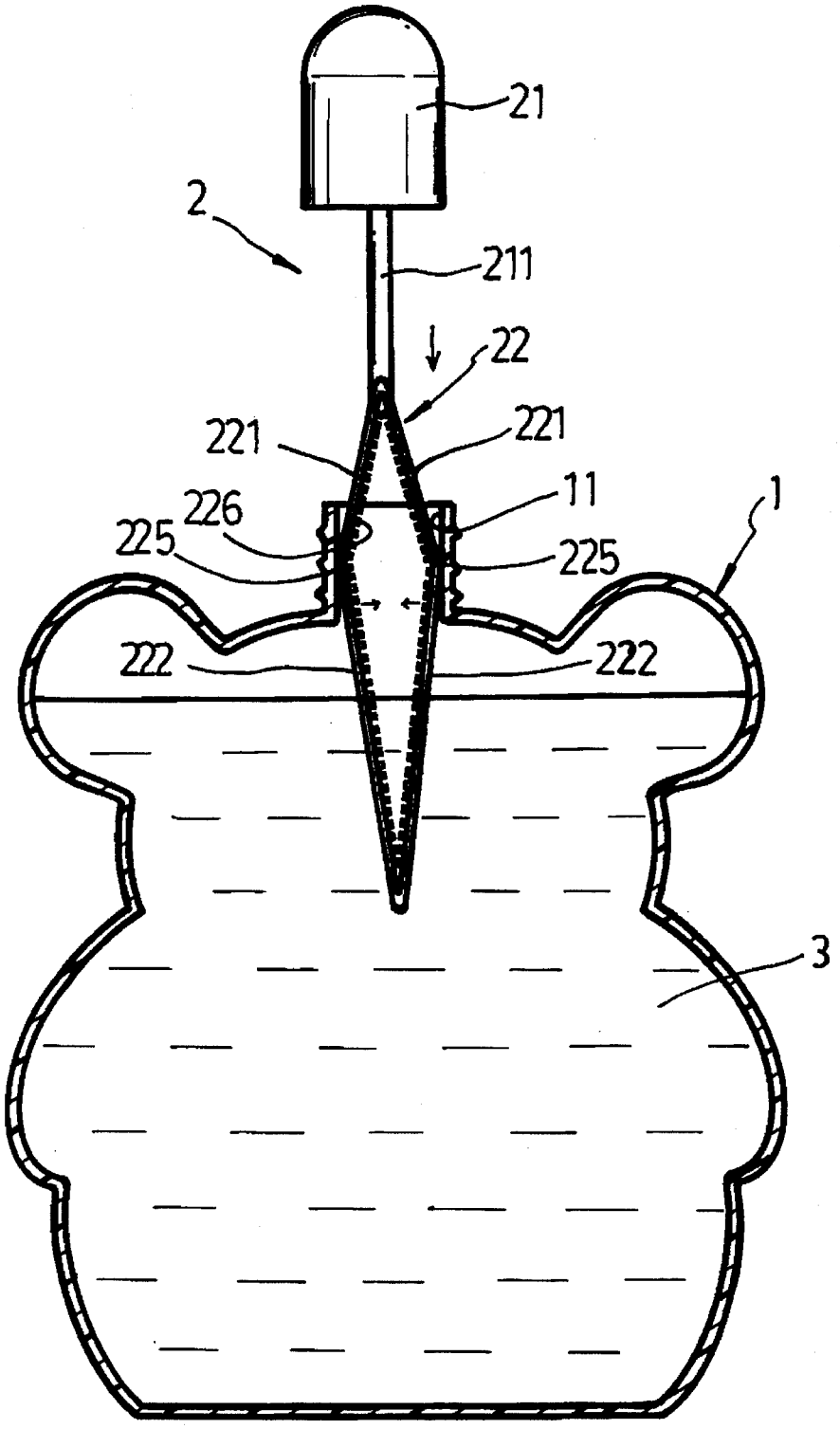
FIG. 6 is similar to FIG. 5 but showing the bubble blowing coil deformed, and the bottom sides of the bubble blowing coil inserted into the inside of the solution container.

Referring to FIGS. 5 and 6, because the bottom sides 222 are relatively longer than the top sides 221, the bubble blowing coil 22 can be conveniently deformed and inserted into the inside of the solution container 1 to pick up the solution 3.

Figure 7:
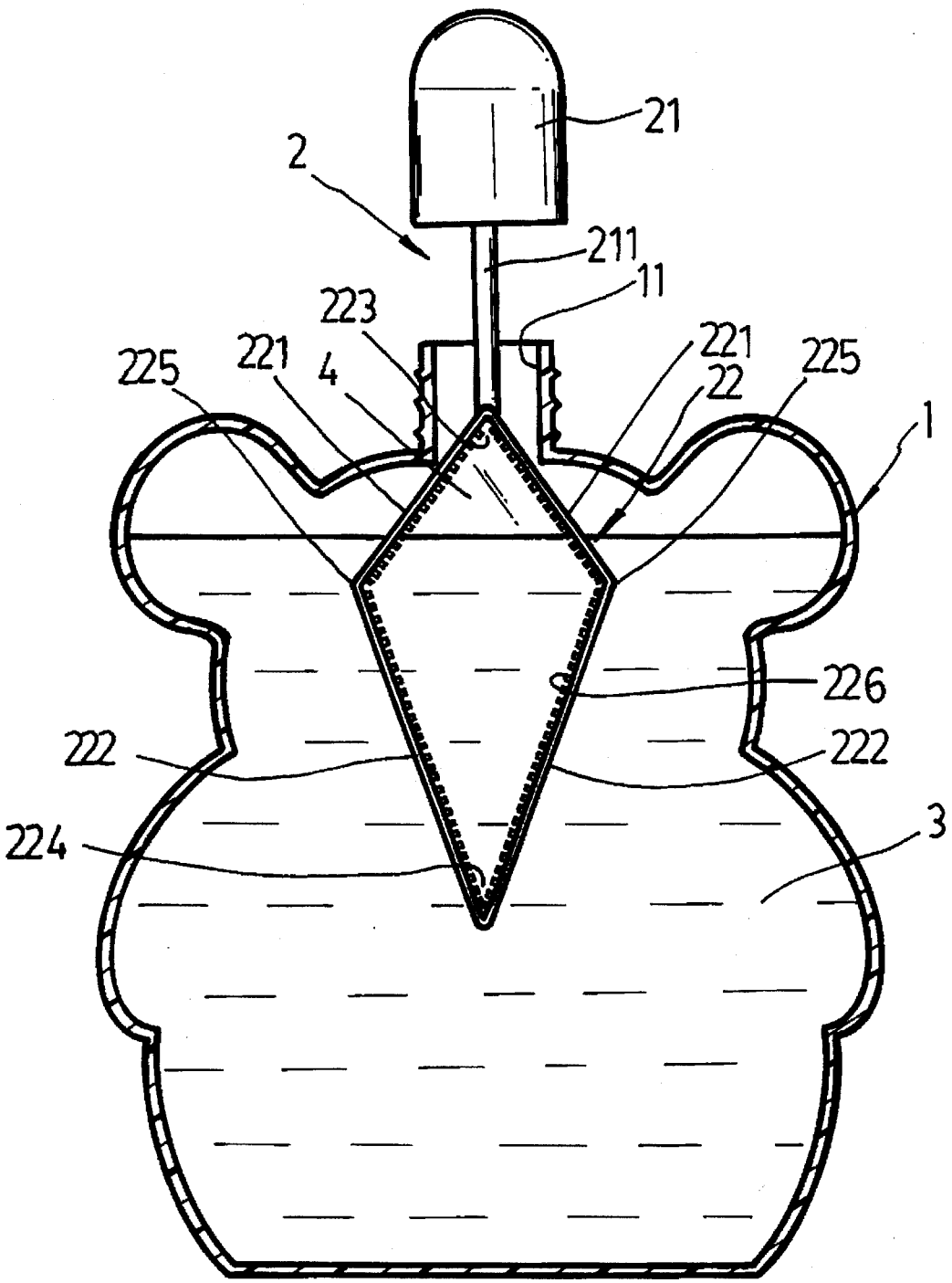
FIG. 7 is similar to FIG. 6 but showing the bottom sides and top sides of the bubble blowing coil passed through the threaded neck into the inside of the solution container.
Figure 8:
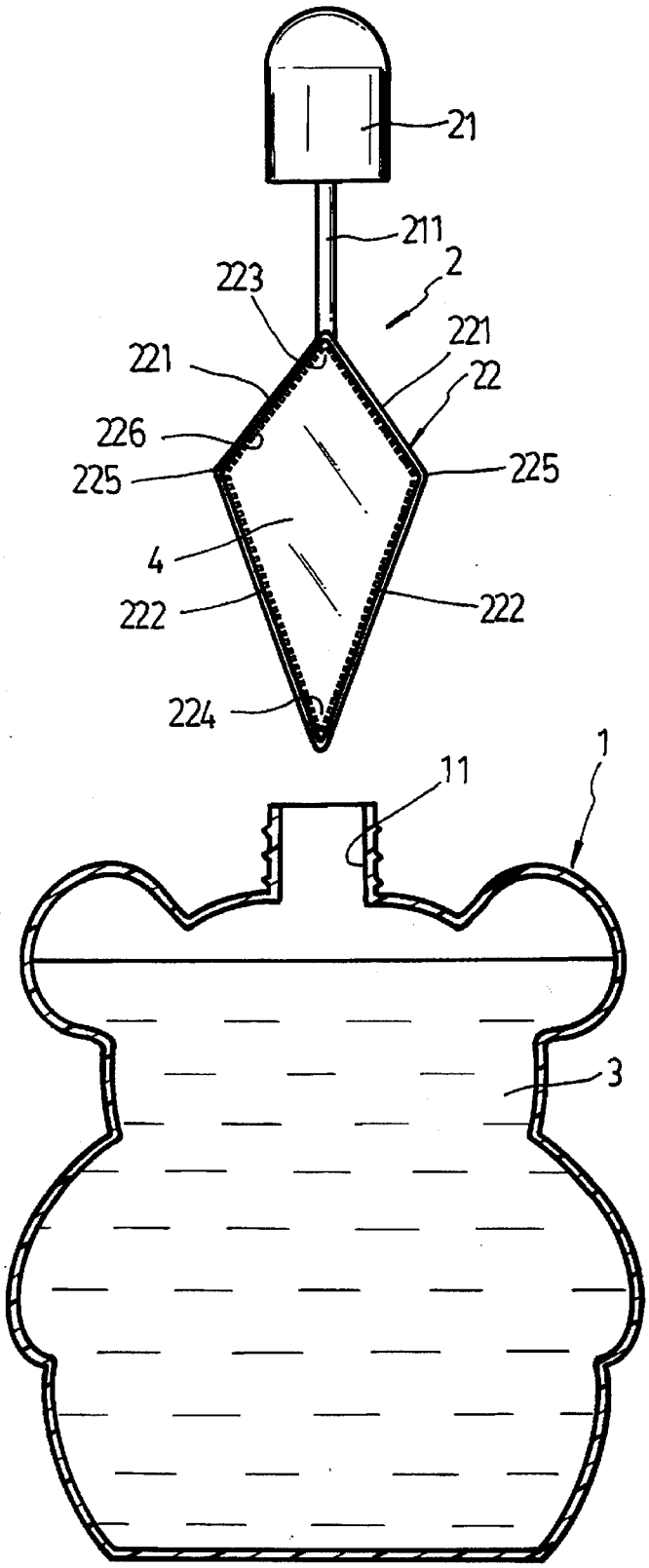
FIG. 8 is another sectional view of the bubble blowing toy shown in FIG. 4, showing the bubble blower removed from the solution container and covered with a layer of the solution.

Referring to FIGS. 7 and 8, when the handle 21 of the bubble blower 2 is pulled upwards from the solution container 1, the bubble blowing coil 22 is forced to deform and to pass out of the threaded neck 11 of the solution container 1. When the bubble flower 2 is disconnected from the solution container 1, the bubble blowing coil 22 is covered with a thin solution layer 4 is stretched on the inside 226 of the bubble blowing coil 22 for blowing into bubbles.

Figure 10:
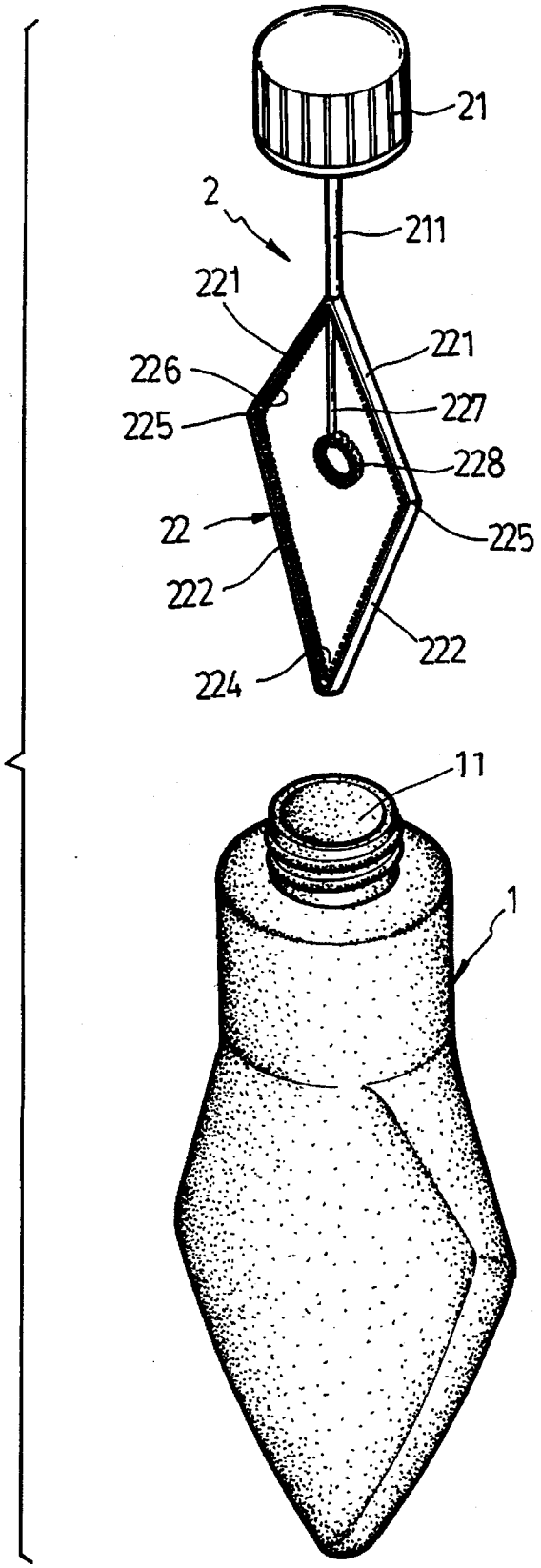
FIG. 10 shows a bubble blowing toy according to another alternate form of the present invention.

Referring to FIG. 10, a small annular bubble blowing coil 228 is suspended from a suspending rod 227 inside the rhombic bubble blowing coil 22 for producing small bubbles.

Figure 11:
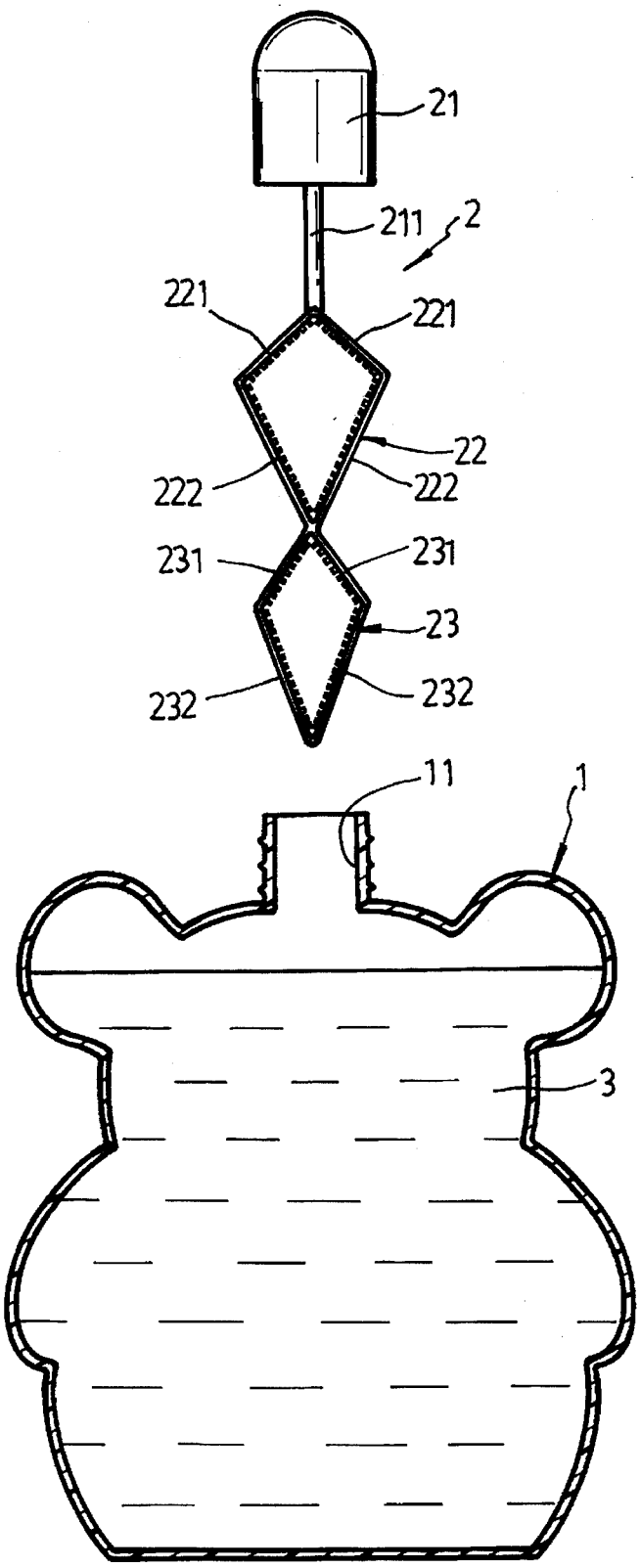
FIG. 11 shows a bubble blowing toy according to still another alternate form of the present invention.

Referring to FIG. 11, an auxiliary hollow rhombic bubble blowing coil 23 which is comprised two top sides 231 and two bottom sides 232 arranged in the same manner as the bubble blowing coil 22, is connected to the connecting area between the bottom sides 222 of the bubble blowing coil 22.

It is to be understood that the drawings are designed for purposes of illustration only, and are not intended as a definition of the limits and scope of the invention disclosed.

What the invention claimed is:

1. A bubble blowing toy comprising:

a) a container for containing a bubble producing solution, the container including a threaded neck having an inner diameter;

b) a bubble blower for picking up the bubble producing solution and blowing same into bubbles by a user, the bubble blower including a stem having a pair of opposite ends, a handle at one end of the stem and a main bubble blowing coil at the other end of the stem, the handle being in the form of a screw cap for threaded attachment to the threaded neck of the container;

c) the main bubble blowing coil being of a hollow rhombic shape and formed of flexible material to permit the coil to deform for insertion through the threaded neck of the container, the coil including a pair of top sides and a pair of bottom sides, each top side including a first end and a second end, the first ends of the top sides being connected to the stem and defining a top angle therebetween, the pair of bottom sides each including a first end and a second end, the first ends of the bottom sides being respectively connected to the second ends of the top sides to define a pair of side angles therebetween, the distance between the side angles being greater than the inner diameter of the threaded neck, the second ends of the bottom sides being connected to define a bottom angle therebetween, and the top angle being larger than the bottom angle.

2. The bubble blowing toy of claim 1 further including an auxiliary bubble blowing coil of hollow rhombic shape and formed of flexible material to permit the auxiliary bubble blowing coil to deform for insertion into the threaded neck of the container, the auxiliary bubble blowing coil including a pair of top sides, each top side including a first end and a second end, the first ends of the top sides being connected together to form a top angle connected to the bottom angle of the main bubble blowing coil, and a pair of bottom sides, each bottom side having a first end and a second end, the second ends of the top sides being connected to the first ends of the bottom sides to form a pair of side angles therebetween, and the second ends of the bottom sides being connected to form a bottom angle therebetween, and the top sides being shorter than the bottom sides.

* * * * *